US006536101B1

(12) United States Patent
Schrömges et al.

(10) Patent No.: US 6,536,101 B1
(45) Date of Patent: Mar. 25, 2003

(54) APPARATUS FOR APPLYING FOILS TO BOARD FACES

(75) Inventors: Guido Schrömges, Nettetal (DE); Heinz-Dieter Schmitz, Krefeld (DE); Ralf Püschel, Kaarst (DE)

(73) Assignee: G. Siempelkamp GmbH & Co., Krefeld (DE)

( * ) Notice: Subject to any disclaimer, the term of this patent is extended or adjusted under 35 U.S.C. 154(b) by 0 days.

(21) Appl. No.: 09/539,523

(22) Filed: Mar. 30, 2000

(30) Foreign Application Priority Data

Mar. 30, 1999 (DE) ..... 199 14 357

(51) Int. Cl.[7] ..... B23P 19/00

(52) U.S. Cl. ..... 29/743; 156/538; 156/556; 156/570

(58) Field of Search ..... 29/743, 729, 738; 156/538, 556, 566, 570, 364

(56) References Cited

U.S. PATENT DOCUMENTS 4,288,274 A * 9/1981 Holtz ..... 156/198
4,519,865 A * 5/1985 Bradler et al. ..... 156/256
4,606,715 A * 8/1986 Larson ..... 425/110

FOREIGN PATENT DOCUMENTS

DE 25 49 903 C3 * 5/1977

* cited by examiner

*Primary Examiner*—David J. Walczak
(74) *Attorney, Agent, or Firm*—Herbert Dubno

(57) ABSTRACT

A foil applicator for particle board and the like has a stack of foils positioned above the transport path for the boards and provided with a suction feeder which delivers the foils to a platform from which the foils are fed by belt feeders to the upper surface of the board. At the upstream of the stack, a further platform is provided and receives foil sheets from the stack and feeds those foil sheets to a suction belt inverter which delivers the sheets in an inverted form to the conveyor for application to the top or bottom of the board.

11 Claims, 3 Drawing Sheets

APPARATUS FOR APPLYING FOILS TO BOARD FACES

FIELD OF THE INVENTION

Our present invention relates to an apparatus for applying at least one facing foil to a face of a board and, more particularly, to a foil-application apparatus for upper-side and/or lower-side applications of facing foils to carrier boards.

BACKGROUND OF THE INVENTION

The term "board" or "carrier board" as used herein is intended to refer, generally, to a structural board which can be composed of particles (particle board) such as fibers (fiber board) or chips (chip board) usually of cellulosic material, e.g. wood. The expressions also apply to laminated boards which can have particle layers or nonparticle layers laminated together by glue or adhesive and to boards laminated from layers of other materials. Such boards are widely used in interior decoration, as paneling for lining rooms and the like and for other decorative or structural purposes.

The foils referred to herein can be foils of decorative paper with various designs, illustrations and printed or photographically-reproduced patterns, other papers which themselves can be laminated from one or more sheets or foils, synthetic resin foils which can be embossed or plain, opaque or transparent, patterned or nonpatterned and the foils may include veneering foils as well.

Such foils are intended to face the board and cover an unaesthetic carrier body with faces of aesthetic value. The foils applied to the board can be bonded thereto in continuous processes or in single-stage or multistage processes.

An apparatus for applying foils to such boards in the art has required two foil pallets or foil stacks. When the board is to be covered on its upper side as well as on its underside with such foils, a respective foil is drawn from each stack. This is especially the case when the foils are decorative papers in which the decor appears only on one side of the paper. At the upper face of the board, the decor must be upwardly while on the underside of the board the decor must face downwardly and the foils in the two stacks are thus oriented accordingly. In the past it has been practically impossible with a simple and economical apparatus to apply a foil from one stack with its decor facing upwardly to the upper surface of the board and the same foil facing downwardly to the lower surface of the foil. As a consequence, the foils were applied to the board by an upper stage and a lower stage with the stacks disposed respectively at the upper level and the lower level and the foils of the stacks oriented appropriately.

In the handling of paper sheets (DE 25 49 903) in the printing field, it is known to engage a sheet from a stack and swing the engaging unit through 180° above a horizontal axis to invert that sheet. To date these systems have not found successful application in the laminating field, in the board-making field and in the application of facing foils to board faces.

OBJECTS OF THE INVENTION

It is, therefore, the principal object of the present invention to provide a foil-application apparatus for the purposes described which can apply foils with the proper orientations to both the upper side of a board and to the lower side of a board economically and reliably, without drawbacks of earlier sheet-inverting systems and without having to turn over a foil stack for that purpose.

Another object of the invention is to provide an improved apparatus for applying at least one facing foil selectively to the upper or lower face of a board which can use a single stack of the foil from which the foils can be drawn for application to the upper and lower sides, respectively.

A further object of this invention is to provide a foil-applying apparatus for boards of the type described whereby disadvantages of earlier systems are obviated.

SUMMARY OF THE INVENTION

These objects and others which will become apparent hereinafter are attained, in accordance with the invention in an apparatus for applying at least one facing foil to a face of a board which comprises:

- a board conveyor for displacing a board to be faced along a board-transport path in a direction of advance;
- first holding means above the path for supporting a stack of foils applicable to a surface of a board displaceable along the path;
- a first suction device capable of entraining foils from the stack and movable back and forth above the stack;
- a first foil deliverer downstream of the stack in the direction and receiving foils from the first suction device;
- a first foil feeder between the first foil deliverer and the path for depositing a foil received from the first foil deliverer onto a board on the conveyor;
- a second foil deliverer upstream of the stack relative to the direction;
- a second suction device capable of entraining foils from the stack and movable back and forth above the stack and depositing foils upon the second foil deliverer; and
- a foil-turning device upstream of the stack relative to the direction, the foil-turning device comprising a suction path guiding foils through 180° from an inlet adjacent the second foil deliverer to an outlet proximal to the conveyor and receiving foils deposited upon the second foil deliverer by the second suction device and inverting foils passing along the suction path for application to a board on the conveyor.

According to the invention, above the board-transport path, a board lifter is provided for raising a board from the board-transport path whereby the foil-turning device can feed a foil beneath the board and the board can be lowered onto the foil beneath the board.

The board lifter can be a suction device and at least one of those deliverers is formed by a telescopic transfer platform and a foil path of foils from the stack along the first foil-deliverer and the first foil-feeder, adjustable for different path lengths.

Each of the deliverers is provided with a blower device for supporting respective foils above respective platforms. Preferably the suction path is formed by a substantially semicircular suction-belt path.

In addition the apparatus can comprise a lower foil applicator with a second foil stack, a third suction device for entraining foils from the second stack, a third foil-feeder for applying a foil from the second stack to an underside of a board on the board-transport path, and a third foil-deliverer between the second stack and the second foil feeder.

It will be apparent that the heart of the invention is the provision, upstream of the first foil stack in the direction of advance of the plate of a foil-turning device forming a suction path for the foil guiding it over about 180° from a mouth of that path adjoining the second foil deliverer onto which the second suction device entrains foils from the same stack that the first suction device delivers those foils ultimately to the top of the board.

That foil suction path ends beneath the level of the stack but above the board conveyor so that, with lifting of the board from the conveyor, an inverted foil can be fed from the first stack beneath the board and can coat the downwardly-turned face of the board with this inverted foil. The top of the board is covered with the first foil in the normal manner and the board now stacked with upper and lower foils can be subjected to lamination. The boards thus receive upper and lower facing foils from a single foil stack located at a single level or stage.

The apparatus of the invention is highly versatile since it allows, with proper adjustment of the outlet of the suction path of the foils, to be located above the board on the conveyor and thus for applying the inverted foil to the upper surface.

When the inverted foil is to be applied to the downwardly-turned face of the board, the board lifter, which can be provided with suction cups which are applied to the board at its upper surface, can lift the board to the extent necessary to allow the inverted foil to be fed beneath the boards. The lifting device can then be lowered to place the board on the inverted foil. The board is stopped for this operation and after the board is placed on the lower foil, the board is again advanced by the conveyor for application of the upper foil in its normal orientation, the upper and lower foils both deriving from the same stack.

The result is a simple reliable two-sided covering of the board with a minimum expenditure of time even when only a single stack of the foils may be available. The inversion does not require complex mechanisms.

According to a further feature of the invention at least the first foil deliverer is formed as a telescoping transfer platform and the transport path of at least the first suction device is adjustable to different path lengths. As a result, different foil sizes can be handled and each alignment of the foil with the board, where the foil meets the board, can always be ensured. The pick-up position and delivery position of the first suction device can likewise be adjusted accordingly. With changes in the foil size, the transfer platform and the foil feeder can be adjusted by reason of the telescoping configurations to assure proper alignment of the foil with the board.

Furthermore, the first foil-suction device and the second foil-suction device can be formed as suction bars which are separately displaceable or can be displaceable together on common guide rails parallel to the board conveyor and preferably at the same level or height above this conveyor.

The first and second foil deliverers or transfer platforms can themselves be equipped with blower devices on which the foil can be supported by air cushions which facilitate the transport of the foils over these platforms.

According to another feature of the invention, the foil inverter is formed by a substantially semicircular suction-belt path which transports the foils generally in a semicircle so that the underside of the transported foil is turned upwardly. The suction belts can serve to deliver the foil beneath the raised board. The board-raising device can also be formed with one or more lifting beams which have suction cups distributed over the surface of the board.

In a variant of the apparatus of the invention, beneath the board conveyor and the foil-inverting device, a separate lower foil applicator can be provided. This applicator can have a second foil stack, a third suction device movable back and forth, a third foil deliverer and a second foil feeder for applying the foil on the third deliverer to a board conveyor beneath a board thereon. In this case, the separate stacks are to provided on upper and lower levels and, while the decorative paper may be fed only from the first stack to both the upper and lower surfaces of the board, a transparent cover foil can be applied from the second stack below the board.

In addition, a third stack can be provided above the first stack and a separate suction device, a foil deliverer and foil feeder can be provided for the foils from the third stack. The latter foils also may be transparent or protective-cover foils if desired. Of course depending upon the foils in the stacks and the programming of the apparatus, a large variety of facing foils can be provided for a board.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
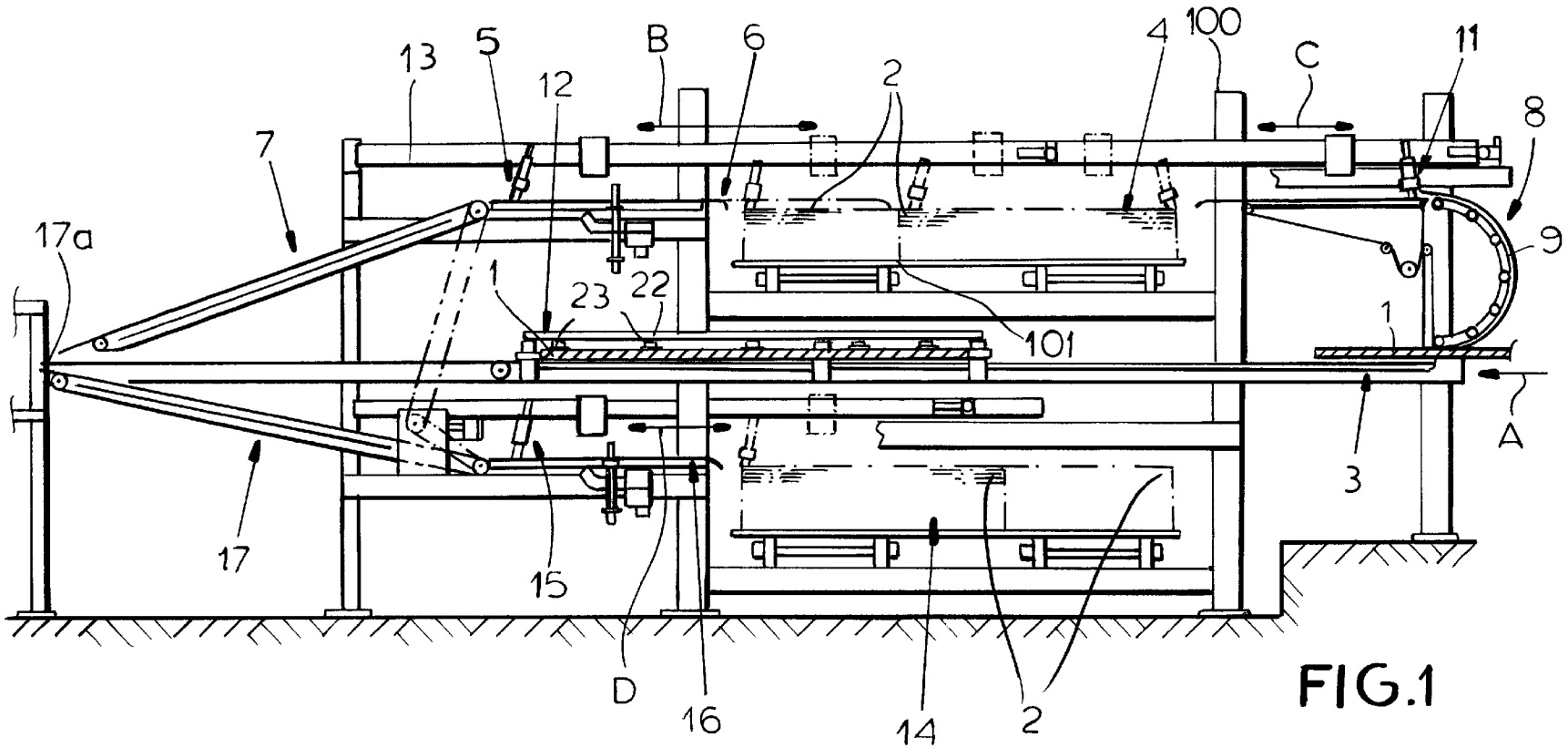
FIG. 1 is a diagrammatic side-elevational view of a facing foil applicator in accordance with the invention.

In the drawing similar reference numerals have been used to identify identical structures in the three embodiments.

Figure 2:
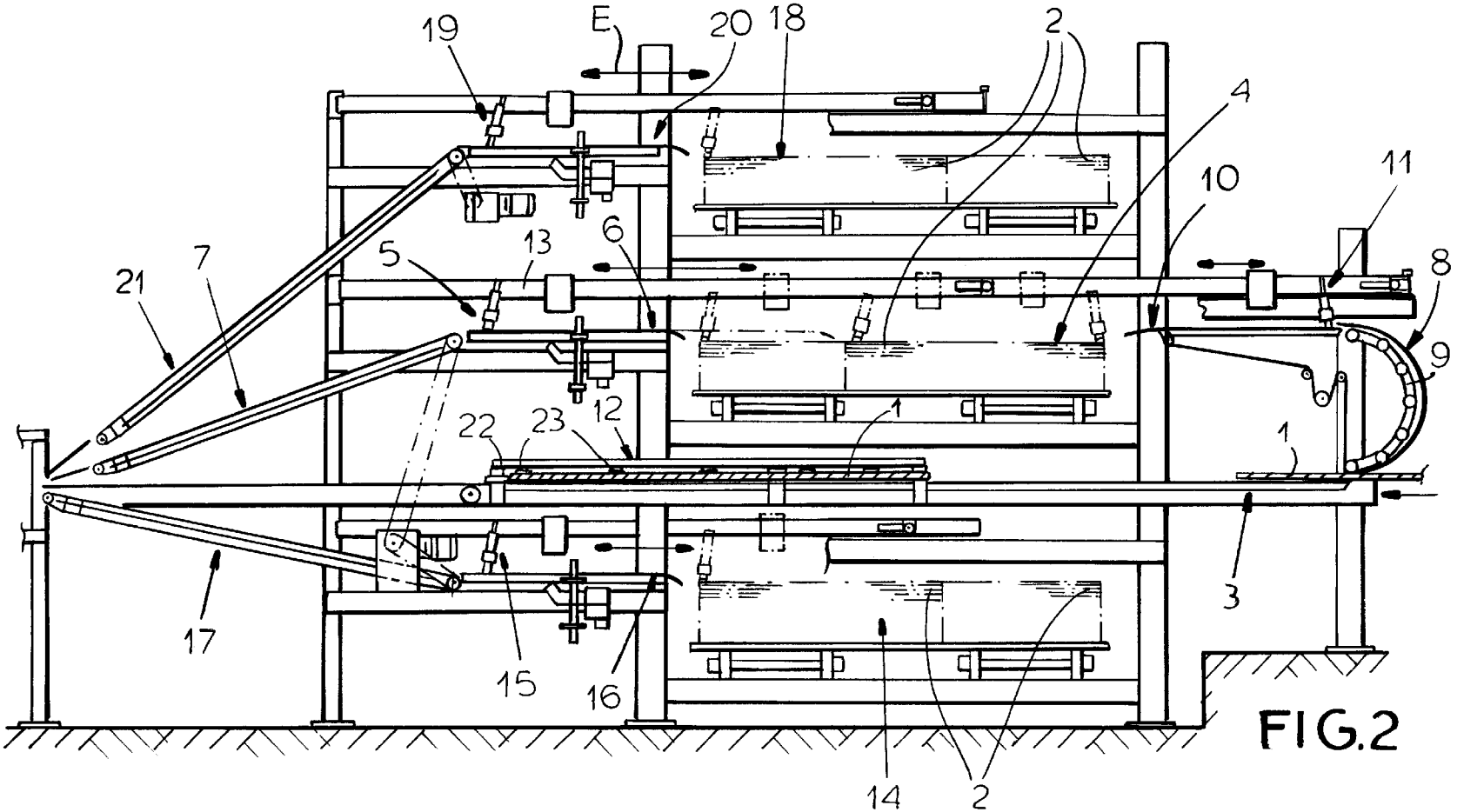
FIG. 2 is a view similar to FIG. 1 showing a foil applicator in accordance with a second embodiment of the invention.
Figure 3:
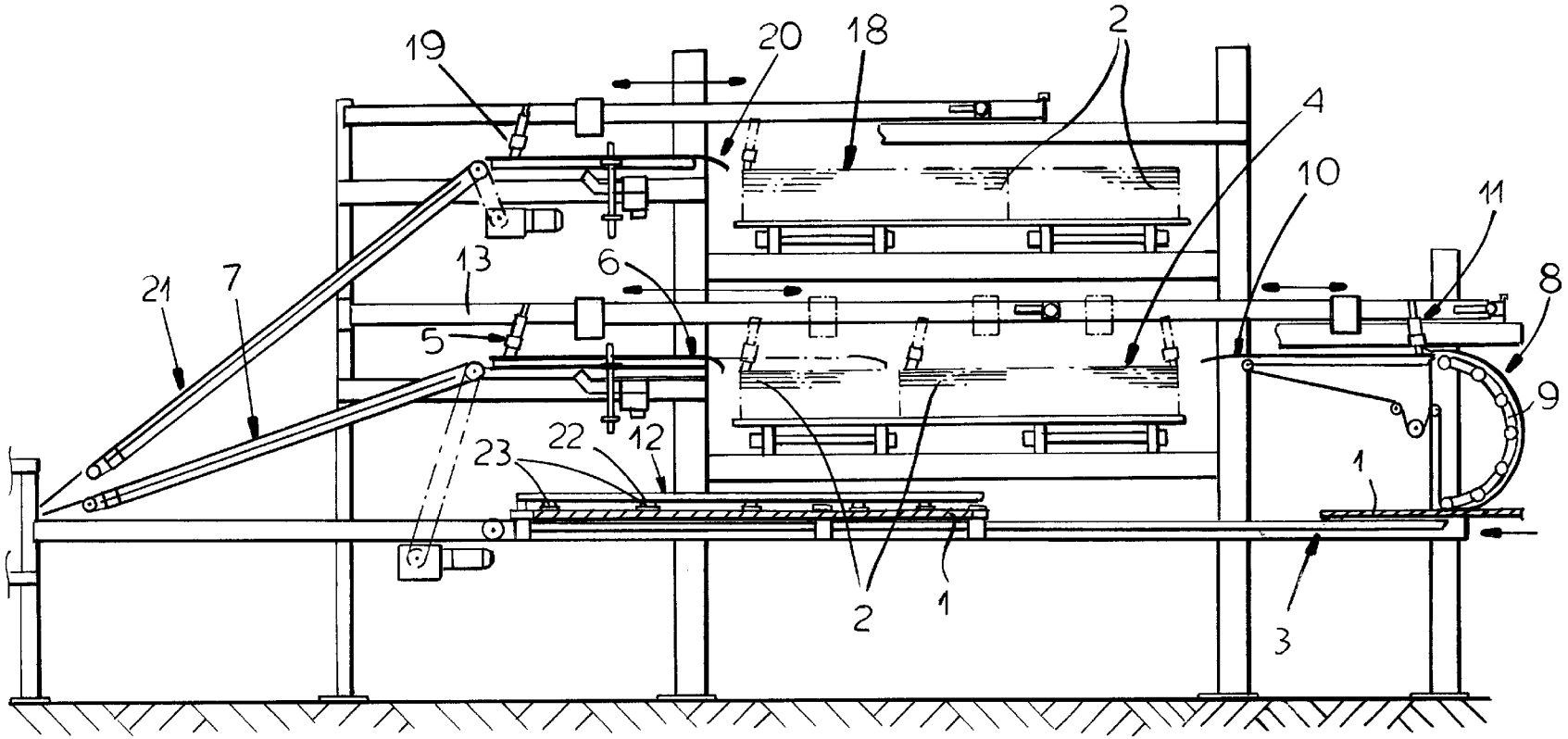
FIG. 3 is another view similar to FIG. 1 showing a third embodiment of the facing foil applicator.

In the embodiment of FIG. 1, a decorative foil or other facing foil can be applied from an upper stack to either or both of the surfaces of a board, depending upon how the apparatus is programmed, the foil from the upper stack being inverted when it is applied to the underside of the board. In addition, a foil may be applied from the lower stack to the underside of the board. In the embodiment of FIG. 2, in addition, a further foil may be applied from a stack above the first stack to the upper surface of the board. In the embodiment of FIG. 3, the foil stacks are provided exclusively above the conveyor path. Otherwise each stack is serviced by a suction device movable back and forth in the direction of travel of the board and except for the inverted foil, has a foil feeder leading from its transfer platform or foil deliverer to meet the board.

Thus in the drawing, the boards 1 are to be provided with facing foils 2 along their upper and/or lower surfaces and for that purpose are displaced along at least one board conveyor. A first foil stack 4 is located above the board conveyor 3 on a first holding means 101. The foil sheets of this stack are engageable by a first foil suction device 5 movable back and forth parallel to the direction of travel of the boards represented by the arrow A in FIG. 1. The first suction device 5 picks up a foil sheet and deposits it upon a foil deliverer 6 which is in the form of a telescoping platform of adjustable width in the direction represented by the arrow D to vary the path length of a foil.

The platform 6 can be supplied with compressed air which forms an air cushion above the platform to support the foil. A first foil feeder 7 receives the foil from the platform and applies it to the upper surface of the board on the conveyor 3. The feeder 7 can be a belt feeder and can be adjustable with the telescoping platform 6.

As has been noted, the transfer platform 6 is a telescoping platform which can be moved relative to the foil feeder 7 as can be seen in dot dash lines in FIG. 1 and as represented by the double headed arrow B. The foil suction device 5 is likewise displaceable along the beam 13 as is represented by the several positions of the suction device also shown in dot dash lines in FIG. 1 and also represented by the double headed arrow. The path of the foil suction device is adjustable as to its length as represented by the double headed arrow B and the positions of the unit illustrated in dot dash lines, to accommodate different foil formats or sizes and to enable the transfer of the different size of the foil. Thus the foil suction device 5 can be displaced to the extent necessary for the foil which lies upon the transfer platform 6 to overlap the foil feeder by a certain extent. The foil suction device 5 then releases the overlapping end of the respective foil, for example, by the shut off of suction, whereupon the foil drops upon the foil feeder 7 which grips the foil and draws it from the transfer platform 6. The foil feeder 7 has an endless belt for this purpose as is also shown in FIG. 1. The telescoping character of the transfer platform 6 and the adjustability of the foil suction device 5 are represented by dot dash lines in FIG. 1 of the drawing.

The foil 2 of the first foil stack 4 may be a decorative paper and the board 1 can be a chip board or fiber board.

Upstream of the first foil stack 4 with respect to the direction of board travel is a foil-inverting device 8 which can comprise a suction-belt path 9 defining a semicircle and capable of engaging a foil on the second platform 10 and entraining that foil while inverting it, to allow on top of a board 1 or, upon lifting of the board, to underlie that board.

The foil inverting device has a foil suction belt path 9 which extends through 180° as can be seen from FIG. 1 and cooperates with a foil suction unit 11 (FIG. 1) referred to below.

Above the first foil stack 4 and shiftable back and forth as represented by the arrow C, preferably independently of the suction device 5, is a second foil suction device 11 which carries the foil from stack 4 onto the platform 10 and across this platform to the suction belt inverter 9.

The back and forth movement of the foil suction device 11 represented by arrow C can feed the foil into the inverter 9 which engages the foil by suction and draws the foil from the stack 4, inverts the foil and deposits the foil on a board 1 arriving in the direction of arrow A as is also apparent-from FIG. 1. For that purpose, the inverter 9 has suction belts which engage the foil until the suction is released at the lower end of the 180° path.

In order to apply the foil to the underside of the board 1, along the frame 100 of the apparatus and preferably downstream of the suction belt inverter 9, a plurality of lifting beams 22 of a suction lifter 12 are provided. The beams 22 are formed with an array of suction cups 23 which allow the beam to engage the board and raise it above the conveyor 3. The hydraulic system for raising and lowering the beam 12 has not been shown in any detail. Once the board 1 is lifted, an inverted foil can be carried by the conveyor beneath the board, whereupon the board is lowered onto it.

As has been noted, at least the first foil deliverer 6 and preferably all of the foil deliverers described here, is formed as a telescoping transfer platform to enable the transport path from that platform to the board to be adjusted to various path ranges depending upon the different foil sizes to be used. The suction devices 5, 11, etc. can have suction beams shiftable along respective rails 13 parallel to the conveyor 3. The rails 13 are common to the suction devices 5 and 11 which have been described. All of the suction platforms can be air-suspension platforms as noted.

In FIG. 1, a separate lower foil applicator with a second foil stack 14 is provided. This applicator has a third suction device 15 displaceable back and forth (arrow D), a third transfer platform or deliverer 16, and a second foil feeder 17 in the form of a belt conveyor which delivers the second foil to the underside of the board as it passes over the discharge end 17*a* of the feeder 17.

In the embodiment of FIG. 2, a third foil stack 18 is provided above the stack 4 and can deliver its foil sheets to the platform 20 via the suction device 19 which is movable back and forth as represented by the arrow E. The platform 20 cooperates with a belt feeder 21 to deliver the foil sheets to the upper surface of the board 1.

In a variant which has not been illustrated, the system of FIG. 1 can omit the lower stack 14 and its applicator. This has been shown for an embodiment like that FIG. 3.

One of the advantages of the system of the invention is low height of the apparatus.

We claim:

1. An apparatus for applying at least one facing foil to a face of a board, comprising:

a board conveyor for displacing a board to be faced along a board-transport path in a direction of advance;

first holding means above said path for supporting a stack of foils applicable to a surface of a board displaceable along said path;

a first suction device capable of entraining foils from said stack and movable back and forth above said stack;

a first foil deliverer downstream of said stack in said direction and receiving foils from said first suction device;

a first foil feeder between said first foil deliverer and said path for depositing a foil received from said first foil deliverer onto a board on said conveyor;

a second foil deliverer upstream of said stack relative to said direction;

a second suction device capable of entraining foils from said stack and movable back and forth above said stack and depositing foils upon said second foil deliverer; and a foil-turning device upstream of said stack relative to said direction, said foil-turning device comprising a suction path guiding foils through 180° from an inlet adjacent said second foil deliverer to an outlet proximal to said conveyor and receiving foils deposited upon said second foil deliverer by said second suction device and inverting foils passing along said suction path for application to a board on said conveyor.

2. The apparatus defined in claim 1, wherein above said board transport path, a board lifter is provided for raising a board from said board transport path whereby said foil-turning device can feed a foil beneath said board and said board can be lowered onto the foil beneath the board.

3. The apparatus defined in claim 2 wherein the board lifter is a suction device.

4. The apparatus defined in claim 2 wherein at least one of said deliverers is formed by a telescopic transfer platform.

5. The apparatus defined in claim 1 wherein said suction devices are respective suction beams separately displaceable parallel to said board conveyor.

6. The apparatus defined in claim 5 wherein said beams are mounted on common rails.

7. The apparatus defined in claim 1 wherein each of said deliverers is provided with a blower device for supporting respective foils above respective platforms.

8. The apparatus defined in claim 1 wherein said suction path is formed by a substantially semicircular suction belt path.

9. The apparatus defined in claim 1 wherein a board lifter is provided along said board transport path and comprises at least one lifter beam formed with a plurality of suction heads spaced over the surface of a board to be lifted by said beam.

10. The apparatus defined in claim 1, further comprising a lower foil applicator with a second foil stack, a third suction device for entraining foils from said second stack, a third foil feeder for applying a foil from said second stack to an underside of a board on said board-transport path, and a third foil deliverer between said second stack and said second foil feeder.

11. The apparatus defined in claim 10, further comprising a third foil stack above said first foil stack, a respective suction device capable of entraining foils from said third stack and movable back and forth above said third stack, a respective foil deliverer downstream of said third stack in said direction and receiving foils from said third stack, and a respective foil feeder for depositing foils from said third stack on a board on said board transport path.

* * * * *